US009726109B2

(12) United States Patent
Boczek

(10) Patent No.: US 9,726,109 B2
(45) Date of Patent: Aug. 8, 2017

(54) PISTON FOR AN INTERNAL COMBUSTION ENGINE

(71) Applicant: Mahle International GmbH, Stuttgart (DE)

(72) Inventor: Sascha-Oliver Boczek, Dielheim (DE)

(73) Assignee: Mahle International GmbH (DE)

( * ) Notice: Subject to any disclaimer, the term of this patent is extended or adjusted under 35 U.S.C. 154(b) by 134 days.

(21) Appl. No.: 14/395,237

(22) PCT Filed: Apr. 15, 2013

(86) PCT No.: PCT/EP2013/057807

§ 371 (c)(1),
(2) Date: Oct. 17, 2014

(87) PCT Pub. No.: WO2013/156442

PCT Pub. Date: Oct. 24, 2013

(65) Prior Publication Data

US 2015/0090215 A1 Apr. 2, 2015

(30) Foreign Application Priority Data

Apr. 18, 2012 (DE) ..... 10 2012 206 392

(51) Int. Cl.
*F02F 3/00* (2006.01)
*F02F 3/20* (2006.01)
*F02F 3/18* (2006.01)

(52) U.S. Cl.
CPC . *F02F 3/20* (2013.01); *F02F 3/18* (2013.01)

(58) Field of Classification Search
CPC .. F02F 3/003; F02F 2003/0061; F02F 3/0015; F02F 3/16; F02F 3/18;
(Continued)

(56) References Cited

U.S. PATENT DOCUMENTS 2,537,174 A * 1/1951 Townhill ..... F02F 3/18 123/41.16
2,729,524 A * 1/1956 Prasse ..... F16J 9/063 277/467
(Continued)

FOREIGN PATENT DOCUMENTS

DE 355072 C 6/1922
DE 1576733 A1 3/1971
(Continued)

OTHER PUBLICATIONS

English abstract for DE-3447394.
(Continued)

*Primary Examiner* — Stephen K Cronin
*Assistant Examiner* — Long T Tran
(74) *Attorney, Agent, or Firm* — Fishman Stewart PLLC

(57) ABSTRACT

A piston for an internal combustion engine may include an encircling ring section in a region of a piston crown. The piston may include a convection region, which has at least one cavity containing a heat transfer medium for dissipation of heat from the piston crown to an underside of the piston. The piston may include a heat insulating region, which is arranged between the ring section and the convection region and thermally insulates the ring section.

20 Claims, 2 Drawing Sheets

(58) Field of Classification Search
CPC ..... F02F 3/0084; F02F 3/0092; F02F 3/20; F02F 3/28; F02F 3/00; F02F 3/08; F01P 3/06; F01P 3/10; F01P 9/00
USPC ..... 123/193.6, 193.1, 193.3, 41.35, 41.36
See application file for complete search history.

(56) References Cited

U.S. PATENT DOCUMENTS

| | | | | |
|---|---|---|---|---|
| 5,474,307 | A * | 12/1995 | DeBiasse | F16J 9/06 277/451 |
| 7,654,240 | B2 * | 2/2010 | Jarrett | F02F 3/0023 123/193.6 |
| 8,011,288 | B2 * | 9/2011 | Gniesmer | F02F 3/003 92/217 |
| 2007/0251487 | A1 * | 11/2007 | Heidrich | F02F 3/22 123/193.6 |
| 2010/0108016 | A1 * | 5/2010 | Scharp | F02F 3/003 123/193.6 |
| 2010/0275873 | A1 * | 11/2010 | Gniesmer | B23K 20/129 123/193.6 |
| 2010/0319648 | A1 * | 12/2010 | Bauer | F02F 3/0023 123/193.6 |
| 2011/0114040 | A1 * | 5/2011 | Hashimoto | F02F 1/14 123/41.72 |
| 2013/0047948 | A1 * | 2/2013 | Heuschmann | F02F 3/22 123/193.6 |
| 2013/0104838 | A1 * | 5/2013 | Spangenberg | F02F 3/16 123/193.6 |
| 2013/0160733 | A1 * | 6/2013 | Bauer | F02F 3/0023 123/193.6 |
| 2014/0130767 | A1 * | 5/2014 | Leitl | F02F 3/22 123/193.6 |

FOREIGN PATENT DOCUMENTS

| | | | |
|---|---|---|---|
| DE | 2930079 | A1 | 3/1981 |
| DE | 8131778.1 | | 11/1982 |
| DE | 8330717.6 | | 12/1984 |
| DE | 3447394 | A1 | 6/1986 |
| DE | 10028926 | A1 | 12/2001 |
| DE | 102004038464 | A1 | 2/2006 |
| DE | 102008035696 | A1 | 2/2010 |
| EP | 0141992 | | 9/1984 |
| FR | 2901577 | A3 | 11/2007 |
| JP | 2000-097338 | A | 4/2000 |
| WO | WO-2013/029592 | A1 | 3/2013 |

OTHER PUBLICATIONS

English abstract for DE-102004038464.
English abstract for DE-102008035696.
English abstract for FR-2901577.
English abstract for JP-2000-97338.
English abstract for DE-10028926.
English abstract for EP-0141992.

* cited by examiner

PISTON FOR AN INTERNAL COMBUSTION ENGINE

CROSS-REFERENCE TO RELATED APPLICATIONS

This application claims priority to German Patent Application No. 10 2012 206 392.7, filed Apr. 18, 2012, and International Patent Application No. PCT/EP2013/057807, filed Apr. 15, 2013, both of which are hereby incorporated by reference in their entireties.

TECHNICAL FIELD

The present invention relates to a piston for an internal combustion engine, having an encircling ring section in the region of a piston crown, a convection region and a heat insulation region arranged between the ring section and the convection region, according to the introductory clause of claim 1.

BACKGROUND

From DE 10 2004 038 464 A1 a generic piston is known, in particular a cooling duct piston, of an internal combustion engine with an upper part and a lower part, which are able to be produced separately from one another and are subsequently able to be joined together, wherein the upper part has at least three radially encircling joining webs and the lower part likewise has at least three radially encircling joining webs, which are brought together during the joining process and via which the upper part is securely connected with the lower part.

From DE 100 28 926 A1 a composite piston is known, having a piston crown of highly heat-resisting material and a lower part containing the hubs, wherein the piston crown and the lower part are connected with one another by a central screw connection. In order to prevent the entry of combustion gases into the piston, the piston crown sits in its outer region with a conical or convex support surface on the lower part or on an intermediate part, wherein between the upper part and the lower part a separating plate is arranged, which separates a cooling duct, present in the lower part, from a cavity present in the upper part.

Highly stressed Otto and diesel engines nowadays already require intensive efforts in order to be able to also guarantee the durability of aluminium pistons in the long term. Through the ever rising temperatures, due to the increase in output, an increasingly rising heat input occurs in the region of piston rings and piston lands, which leads to an increased build-up of oil carbon on the piston rings and in particular in the groove base. This oil carbon layer, in turn, functions as an insulator and can contribute to the overheating of the piston rings and therefore to a damage thereto.

SUMMARY

The present invention is therefore concerned with the problem of indicating an improved embodiment for a piston of the generic type, in which in particular through an improved heat dissipation the efficiency and the durability of the piston can be increased.

This problem is solved according to the invention by the subject of the independent claim 1. Advantageous embodiments are the subject of the dependent claims.

The present invention is based on the general idea of implementing a heat dissipation in a piston of an internal combustion engine substantially from a piston crown directly to a piston underside, and to uncouple a ring section in the region of a piston crown thermally therefrom, so that in particular the high temperatures occurring hitherto in the region of the ring section, which for example was able to lead to the formation of oil carbon and, connected therewith, to a damage to the piston rings, can be reliably prevented. The piston according to the invention has, in a known manner, an encircling ring section in the region of the piston crown, a heat insulation region, which is preferably constructed as an encircling outer duct in the region of the ring section, and a convection region, which is preferably constructed as an inner duct arranged coaxially thereto. According to the invention, the heat insulation region is arranged between the ring section and the convection region and insulates the ring section and therefore also the piston rings thermally with respect to the convection region.

The convection region comprises one or more cavities, preferably an inner duct constructed as a cooling duct, which contains a heat transfer medium for the dissipation of heat from the piston crown to the underside of the piston by convection. The inner duct can be constructed as a continuous, encircling duct. It preferably contains a heat transfer medium which is liquid at the designated operating temperatures of the piston.

The heat insulation region preferably likewise comprises one or more cavities, particularly preferably a continuous, encircling outer duct. Here, preferably, air, another gas, vacuum or another poorly heat-conducting material, such as for example a metal foam, is arranged in the outer duct, so that a heat transfer from the piston crown or respectively from the inner duct via the outer duct towards the ring section is at least reduced. The outer duct could, however, also be filled completely with a solid material, the thermal conductivity of which lies below that of the piston material. The ring section itself can be cooled via the piston rings running along a cylinder wall, wherein this cooling is sufficient without problems, in so far as a thermal uncoupling from the piston crown or respectively in particular from a piston bowl, can be guaranteed. In the piston according to the invention, the ring section is therefore thermally insulated by the outer duct with respect to the inner duct and the piston crown or respectively a piston bowl, whereby the thermal stress in the region of the ring section and therefore also in the region of the piston rings can be distinctly reduced, so that the carbonisation of the oil occurring here hitherto can preferably be avoided entirely.

In an advantageous further development of the solution according to the invention, the outer duct and the inner duct are separated from one another by a dividing wall, which is constructed either as a separate structural part or as an integral component of the piston. In an embodiment of the dividing wall as a separate structural part, for example the outer duct can be produced by a corresponding turning of a duct half into an inner side of the ring section, and the inner duct can be produced by a corresponding turning of a counter duct half into an outer side of the upper part of the piston. Subsequently, the dividing wall is installed in the manner of an insert part, and the piston upper part is securely connected, for example welded, to the piston lower part. In this case, therefore, the piston is constructed as a composite piston and comprises the piston upper part, piston lower part and the dividing wall. The dividing wall is fixed here for example likewise by a welded connection or by a simple clamping in the piston. If, on the other hand, the dividing wall is constructed as an integral component of the piston, the latter usually comprises the piston upper part, the piston lower part and a ring section part, wherein the dividing wall itself forms an integral component of the piston lower part. Here, also, the concern is with a form of a composite piston, in which the piston upper part and the piston lower part and the ring section part with the piston upper part and the piston lower part are welded to one another. Irrespective of the construction of the dividing wall, the latter ensures a separation of the outer duct from the inner duct and therefore the construction of the outer duct as a heat insulator and of the inner duct as cooling duct.

Expediently, the dividing wall is constructed from spring steel, in particular from spring plate or from plastic, in particular from polyimide (PI) or polyetheretherketone (PEEK). This list already suggests that the actual dividing wall, in so far as this is produced as a separate component to the piston, can be realized by the most varied of materials, wherein in particular the use of temperature-resistant plastic is particularly advantageous, because the latter on the one hand is light and on the other hand has a low thermal conductivity. The low weight tends in particular to reduce the energy necessary for the piston movement, whereas the poor thermal conductivity additionally reduces a heat transfer from the piston bowl or respectively in the piston crown towards the ring section.

In a further advantageous embodiment of the solution according to the invention, the heat transfer medium is a liquid metal, in particular sodium or potassium. All sodium-potassium alloys melt below 100° C. and are therefore liquid during the operation of the internal combustion engine and have, moreover, a high thermal conductivity, which enables a rapid heat dissipation from the piston crown towards the piston underside.

Preferably, the heat transfer medium only partially fills the cooling duct, whereby during the operation of the internal combustion engine it is set into an alternating upward and downward movement by the inertia forces in relation to the piston. Here, the liquid receives heat on the upper side, in relation to the usual installation position of the piston in an internal combustion engine, facing the piston crown, and emits this heat at the lower side facing away from the piston crown. In this way, by means of enforced convection, a substantially higher heat flow density can be achieved in a substantially axial or respectively vertical direction, i.e. away from the piston crown, than would be possible by heat conduction alone. Furthermore, in accordance with the invention a heat transfer medium, such as e.g. a liquid metal, can be used, which can be exposed to higher temperatures than approximately 300° C., which conventional engine oil withstands without damage. Thereby, the piston crown can also reach very high temperatures, without oil carbonising, which is circulating in an adjacent cooling duct. The temperature only needs to be lower on the piston underside, which is sprayed with oil for cooling. Alternatively, a further encircling conventional cooling duct could also be present there, into which in the conventional manner oil is sprayed via corresponding feed and discharge openings respectively from the piston underside, wherein the convection region according to the invention is then arranged substantially between the piston crown and the conventional oil-supplied cooling duct.

Of course, other cooling fluids than liquid metals are also conceivable, wherein for better heat transfer the cooling duct is constructed as a closed cooling duct and the heat transfer medium situated therein is a different one than the oil spraying the piston underside.

According to the invention, the heat insulation region arranged between the ring section and the convection region causes the transport of heat to be reduced in a substantially horizontal or respectively radially outward direction compared with the thermal conductivity of the piston material. Thereby, the high temperatures of the heat transfer medium, such as e.g. of the liquid metal in the inner duct do not lead to an excessive heat input into the ring section with the formation of oil carbon in the ring grooves.

In a further advantageous embodiment of the solution according to the invention, the dividing wall is arranged obliquely to the piston axis, i.e. is constructed in cross-section in the manner of a plate spring and has a smaller diameter in the region of the piston crown. The oblique position of the dividing wall causes here, in the case of a downward movement of the piston, a flowing of the heat transfer medium along the dividing wall, whereupon the latter is cooled, whereas in the case of an upward movement of the piston, the greatly heated heat transfer medium is conveyed away quickly from the piston crown to the piston underside, where it is cooled again by the spraying of oil. The inclined position of the dividing wall constitutes a significant improvement to the cooling effect here.

Further important features and advantages of the invention will emerge from the sub claims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical structural parts.

BRIEF DESCRIPTION OF THE DRAWINGS

There are shown, respectively diagrammatically.

DETAILED DESCRIPTION

Figure 1:
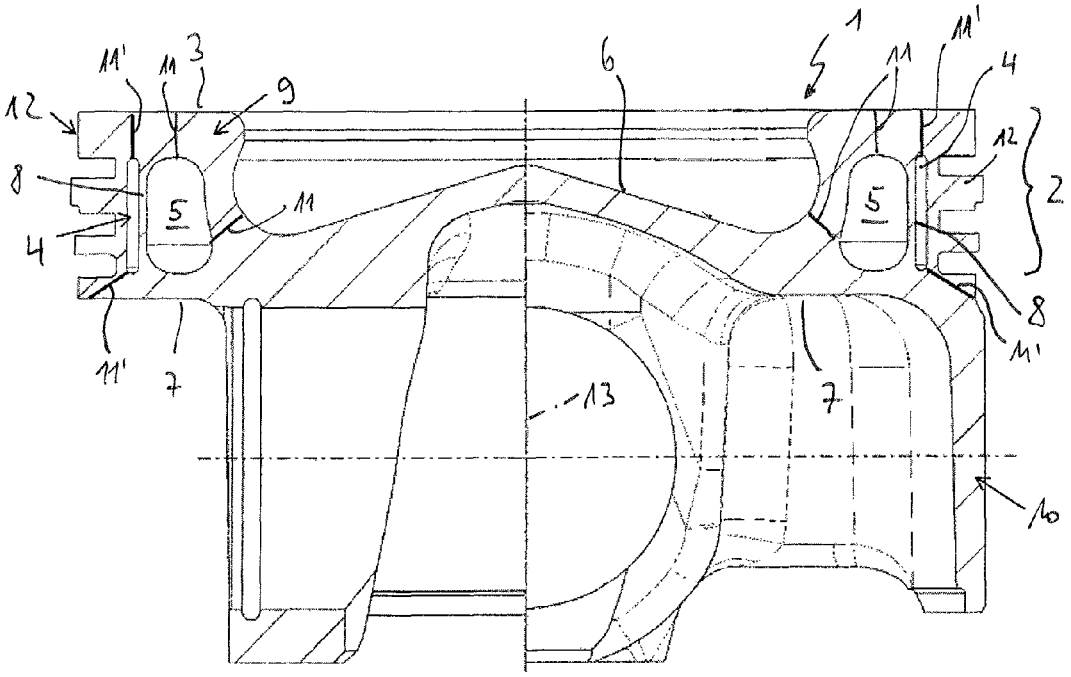
FIG. 1 a sectional illustration through a piston according to the invention with a dividing wall between an outer and an inner duct, which forms an integral component of the piston, FIG. 2 an illustration as in FIG. 1, but with a dividing wall as a separate structural part, FIG. 3 an illustration as in FIG. 2, but with an obliquely positioned dividing wall, FIG. 4 an illustration as in FIG. 3, but with a composite piston.

According to FIGS. 1 to 4, a piston 1 according to the invention for an internal combustion engine which is otherwise not illustrated has an encircling ring section 2 in the region of a piston crown 3 and an encircling outer duct 4 in the region of the ring section 2, and an inner duct 5 arranged coaxially thereto. According to the invention, the outer duct 4 is now constructed as a heat insulator and insulates accordingly the ring section 2 thermally from the inner duct 5 and a piston bowl 6, also designated combustion chamber bowl, whereas the inner duct 5 is constructed as a cooling duct and contains a heat transfer medium for the dissipation of heat from the piston crown 3 to the piston underside 7 of the piston 1.

Figure 2:
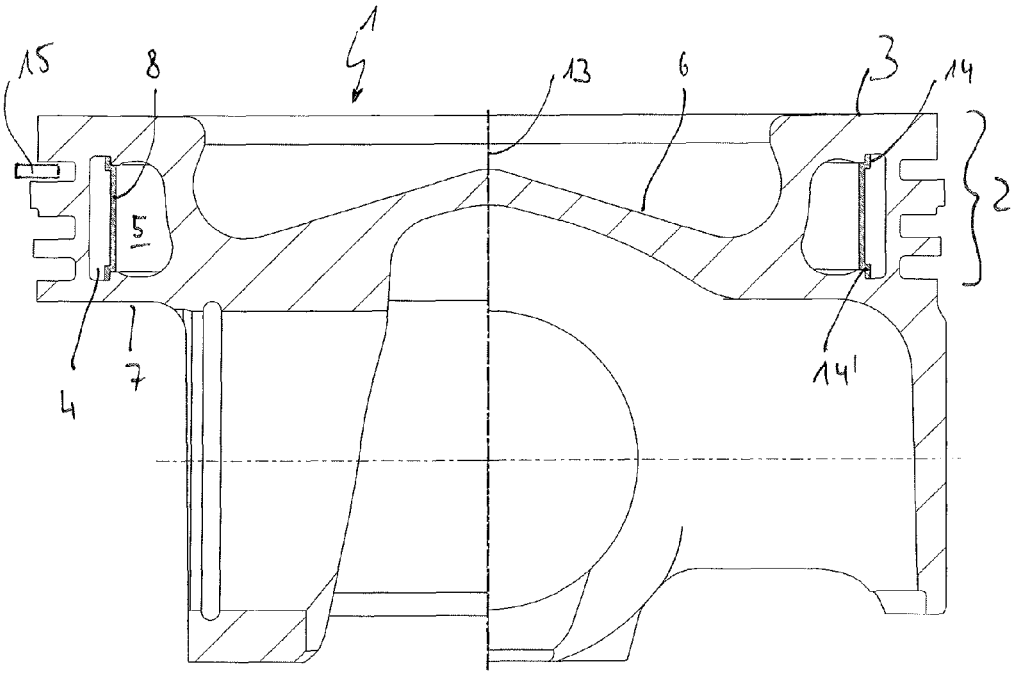
Figure 3:
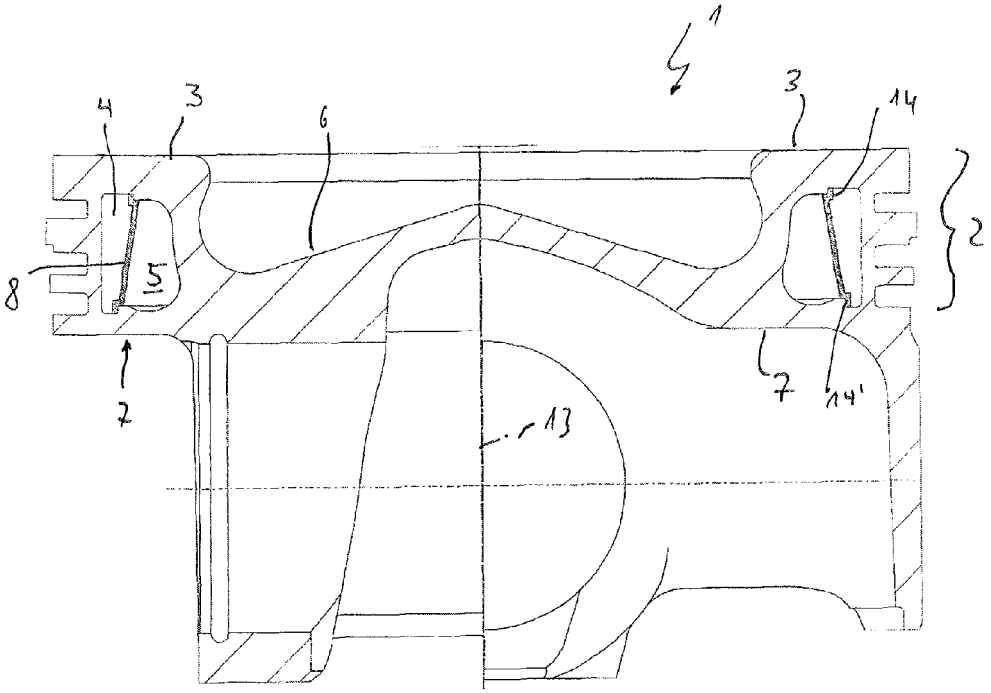
Figure 4:
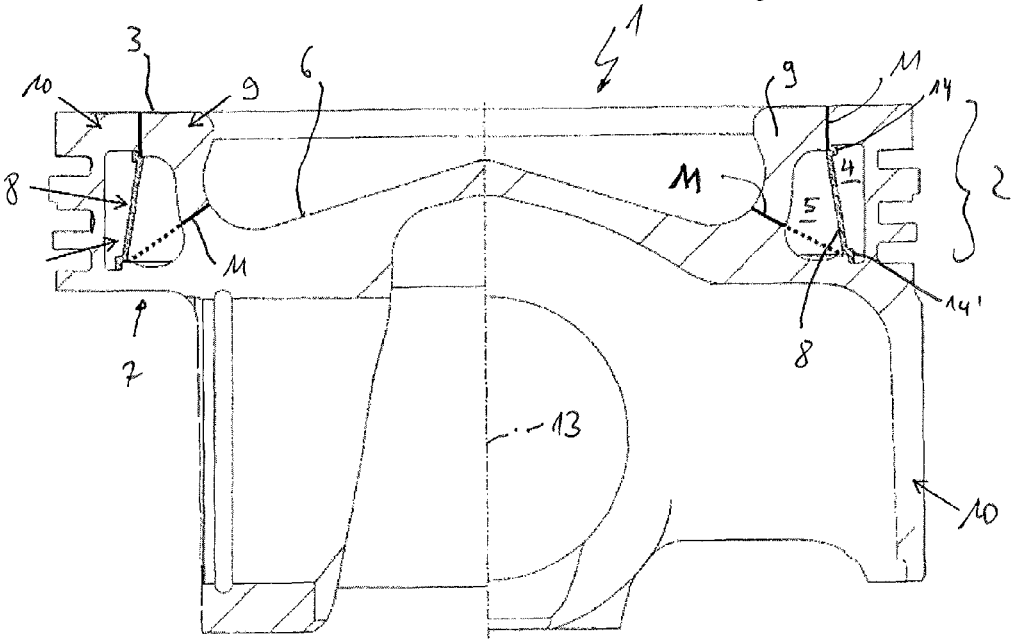

The outer duct 4 and the inner duct 5 are separated from one another here by a dividing wall 8, wherein this dividing wall can be constructed as a separate structural part, as is illustrated in particular in FIGS. 2 to 4, or wherein this dividing wall 8 forms an integral component of the piston 1, as is illustrated according to FIG. 1. In the case of a separate construction of the dividing wall 8, the latter can be constructed for example from spring steel, in particular from spring plate, or from plastic, in particular from polyimide (PI) or polyetheretherketone (PEEK). Especially the construction from plastic offers a weight advantage, which is not to be underestimated, and the advantage of the low thermal conductivity, which in addition contributes to thermally uncoupling the ring section 2 from the piston bowl 6 or respectively from the piston crown 3.

Generally, the piston 1 can be constructed for example as a single-piece piston 1, wherein in this case the outer duct 4 and the inner duct 5 are formed by corresponding salt- or respectively sand cores, wherein alternatively it is also conceivable that the dividing wall 8 is introduced as an insert part in these salt or respectively sand cores. Alternatively hereto, the piston 1 can also be constructed as a composite piston and can comprise a piston upper part 9, a piston lower part 10 and the dividing wall 8 (cf. FIG. 4). The piston upper part 9 and the piston lower part 10 are welded to one another here, for example via welding points 11, wherein the dividing wall 8 is likewise fixed by a welded connection or else by a simple clamping.

Alternatively hereto, the piston 1 can likewise be constructed as a composite piston and can comprise a piston upper part 9, a piston lower part 10 and a ring section part 12, as is illustrated for example according to FIG. 1. In this case, the piston upper part 9 and the piston lower part 10 are now welded to one another via first welding points 11, and the ring section part 12 with the piston upper part 9 and with the piston lower part 10 via second welding points 11', wherein the dividing wall 8 forms an integral component of the piston lower part 10.

The piston 1 can generally be produced as a steel piston or as a light metal piston, in this case in particular from aluminium. In this case, the piston 1 is produced by a casting process, wherein the dividing wall 8 can be constructed either as a separate insert part or else as an integral component of the piston 1.

Preferably a heat-insulating material, in particular air or, for example, a metal foam, is arranged in the outer duct 4, whereas a heat transfer medium, for example a liquid metal, in particular sodium, potassium or an alloy containing sodium and/or potassium, is enclosed in the inner duct 5. The sodium- or potassium alloy in the inner duct 5 can be introduced for example as a paste or solid material and can become liquid owing to the lower melting point during the operation of the internal combustion engine. Here, in particular, the eutectic alloy with a potassium component of 78% and a melting point of −11° C. is favourable for an optimum heat transfer. NaK alloys are liquid in a wide range of their mixture ratio at room temperature and in any case at conventional operating temperatures of the piston of an internal combustion engine. A liquid heat transfer medium can be filled into the cooling duct through an opening provided for this, which opening can subsequently be closed e.g. by welding or pressing in of a steel ball with an interference fit. A heat transfer medium which is solid at room temperature but liquid at operating temperature can advantageously be introduced into the cooling duct already during the manufacture of the piston e.g. by friction welding and enclosed there, whereby a subsequent filling and closing of the cooling duct is avoided.

The dividing wall 8 can be aligned, furthermore, parallel to the piston axis 13, as is illustrated for example according to FIGS. 1 and 2, or else obliquely thereto, as is illustrated for example according to FIGS. 3 and 4. In the case of a dividing wall 8 aligned obliquely to the piston axis 13, this dividing wall has a cross-section in the manner of a plate spring and has a smaller diameter in the region of the piston crown 3 than in the region of the underside 7. On a downward movement of the piston 1, therefore, the heat transfer medium, for example sodium or potassium, is directed along the dividing wall 8, whereby the latter is cooled and therefore the thermal uncoupling of the ring section 2 is promoted. On an upward movement of the piston 1, on the other hand, the heat transfer medium, which has now received heat from the piston crown 3 and the piston bowl 6, arrives in a direct path to the piston underside 7, where it is cooled by a spray cooling, for example by oil. This brings about a particularly effective cooling.

The dividing wall 8 can have, moreover, angled edge regions 14, 14', via which it rests on the piston 1 (cf. in particular FIGS. 2 to 4). The dividing wall 8 therefore forms a heat barrier, which in particular prevents the ring section 2, and hence also the piston rings 15 arranged thereon (cf. FIG. 2), from becoming too hot, which would bring about, for example, a carbonisation of the oil and hence, in turn, a poorer heat transfer between the cylinder wall and the ring section 2. A poor heat transfer between the cylinder wall and the piston rings 15, and therefore the piston 1, brings about an excessive thermal stress in particular of the ring section 2 and can lead, in so doing, to an overheating of the piston rings 15. A welding of the individual parts 9, 10 and 12 of the piston 1 can take place for example by means of laser welding or friction welding.

With the piston 1 according to the invention, and in particular with the thermally separated ring section 2, a particularly effective cooling and hence a high efficiency and a high durability of the piston 1 can be achieved.

The invention claimed is:

1. A piston for an internal combustion engine, comprising:
- an encircling ring section in a region of a piston crown;
- a convection region having at least one cavity with an inner duct and configured to contain a heat transfer medium including liquid metal for dissipation of heat from the piston crown to an underside of the piston; and
- a heat insulation region with an outer duct radially outward and fluidically separated from the inner duct for liquid metal and arranged between the ring section and the convection region to thermally insulate the ring section, wherein the inner duct for liquid metal is arranged is radially inside the outer duct.

2. The piston according to claim 1, wherein the inner duct for liquid metal is concentric to the outer duct.

3. The piston according to claim 2, wherein the outer duct and the inner duct for liquid metal are fluidically separated from one another by a dividing wall, wherein the dividing wall is constructed an integral component of the piston.

4. The piston according to claim 3, wherein the dividing wall, with a separate construction fluidically separating the outer duct and the inner duct for liquid metal, includes at least one of spring steel and plastic.

5. The piston according to claim 3, wherein:
- the piston is a composite piston and includes a piston upper part, a piston lower part and the dividing wall, or
- the piston is a composite piston and includes a piston upper part, a piston lower part and a ring section part.

6. The piston according to claim 5, wherein the dividing wall is fixed by clamping.

7. The piston according to claim 6, wherein the dividing wall is arranged obliquely to a piston axis.

8. The piston according to claim 7, wherein the dividing wall has a cross-section of a plate spring and has a smaller diameter in a region of the piston crown than in a region of the underside.

9. The piston according to claim 6, wherein the dividing wall has angled edge regions via which the dividing wall rests on the piston.

10. The piston according to claim 3, wherein the dividing wall is arranged obliquely to a piston axis.

11. The piston according to claim 10, wherein the dividing wall has a cross-section of a plate spring and has a smaller diameter in a region of the piston crown than in a region of the underside.

12. The piston according to claim 3, wherein the dividing wall has angled edge regions, via which the dividing wall rests on the piston.

13. The piston according to claim 3, wherein the dividing wall is formed from at least one of a spring plate, a polyimide and polyetheretherketone (PEEK).

14. The piston according to claim 1, wherein the piston is at least one of steel and a light metal.

15. The piston according to claim 1, wherein the piston is produced by a casting process, and the dividing wall is constructed as an insert part.

16. The piston according to claim 1, wherein the liquid metal is introduced into the inner duct as a paste or solid material.

17. The piston according to claim 16, wherein the liquid metal includes at least one of sodium, potassium and an alloy containing at least one of sodium and potassium.

18. A piston for an internal combustion engine, comprising:

a piston crown having an encircling ring section for receiving piston rings, the piston crown having an outer duct in a region of the ring section and an inner duct arranged radially inside the outer duct and concentric to the outer duct;

a heat-insulating material arranged in the outer duct for thermally insulating the ring section;

a heat transfer medium including liquid metal enclosed in the inner duct for dissipation of heat from the piston crown to an underside of the piston by convection; and a dividing wall fluidically separating the outer duct from the inner duct for liquid metal, wherein the dividing wall is arranged obliquely to a piston axis such that the dividing wall has a smaller diameter in the region of the piston crown than in a region of the underside.

19. The piston according to claim 18, wherein the heat-insulating material includes at least one of air and a metal foam.

20. The piston according to claim 18, wherein in the dividing wall is at least one of a spring steel, a polyimide and polyetheretherketone.

* * * * *